United States Patent [19]

Schöneweiss

[11] 4,360,078

[45] Nov. 23, 1982

[54] DEVICE FOR PLACING ESCALATORS IN AND OUT OF OPERATION

[75] Inventor: Klaus Schöneweiss, Hattingen, Fed. Rep. of Germany

[73] Assignee: O&K Orenstein & Koppel Aktiengesellschaft, Berlin, Fed. Rep. of Germany

[21] Appl. No.: 155,685

[22] Filed: Jun. 2, 1980

[30] Foreign Application Priority Data

Jun. 5, 1979 [DE] Fed. Rep. of Germany ..... 2922831

[51] Int. Cl.[3] ..... B66B 9/20

[52] U.S. Cl. ..... 187/12; 312/328

[58] Field of Search ..... 187/12, 28, 1 R; 198/321, 322, 323; 312/251, 223, 242, 248, 329, 328

[56] References Cited

U.S. PATENT DOCUMENTS

| | | | |
|---|---|---|---|
| 1,727,558 | 9/1929 | Price | 312/328 |
| 2,498,898 | 2/1950 | Rieth | 312/328 |
| 2,710,329 | 6/1953 | Herterick | 312/223 |
| 2,873,983 | 2/1959 | Kroemer et al. | 312/328 |
| 2,987,355 | 6/1961 | Sandefar | 312/328 |
| 3,762,790 | 10/1973 | Neawirth | 312/328 |

*Primary Examiner*—Robert J. Spar
*Assistant Examiner*—Kenneth Noland
*Attorney, Agent, or Firm*—Martin A. Farber

[57] ABSTRACT

A device for placing escalators in and out of operation and having a system comprising safety switches, actuating elements and signal bodies. An outwardly swingable flap is provided having a rear side facing an interior of the escalator. Actuating elements for starting and stopping the escalator and monitoring elements are fastened on the rear side of the flap.

8 Claims, 3 Drawing Figures

DEVICE FOR PLACING ESCALATORS IN AND OUT OF OPERATION

The present invention relates to a device for placing escalators in and out of operation, having a system which consists of safety switches, actuating elements and signal bodies.

In one known arrangement for actuating escalators, the switches necessary for the actuation of the escalator, the emergency switch and the signal lamp serving for monitoring are fastened at the head of the escalator alongside of each other by means of screw attachments, etc. Aside from the fact that arrangement thereof in the limited space is difficult, the parts of such an arrangement must be individually cumbersomely unscrewed in case of replacement or repair and then screwed on again.

The object of the present invention is to arrange the large number of required switches, signal lamps, actuating knobs or buttons and fuses in such a manner that easy replacement is possible and that assurance against unauthorized operation is increased.

This purpose is achieved in accordance with the invention in the manner that the system is developed as a flap (13) which can be swung out and on its rear which faces the inside of the escalator there are fastened the actuating elements (28, 34, 35, 46, 47, 48) which serve for the starting or stopping of the escalator as well as the elements (39, 40, 52) which serve for monitoring.

The advantage of the arrangement in accordance with the invention is that a buildingblock system is created which permits easy and rapid assembling and replacement of the switch and signal elements. The swinging out of the compact operating unit which is of well-defined dimensions permits optimum servicing of the elements, which are easily seen and readily accessible after swinging the flat out. With the above and other objects and advantages in view, the present invention will become more clearly understood in connction with the detailed description of a preferred embodiment, when considered with the accompanying drawings, of which:

Figure 1:
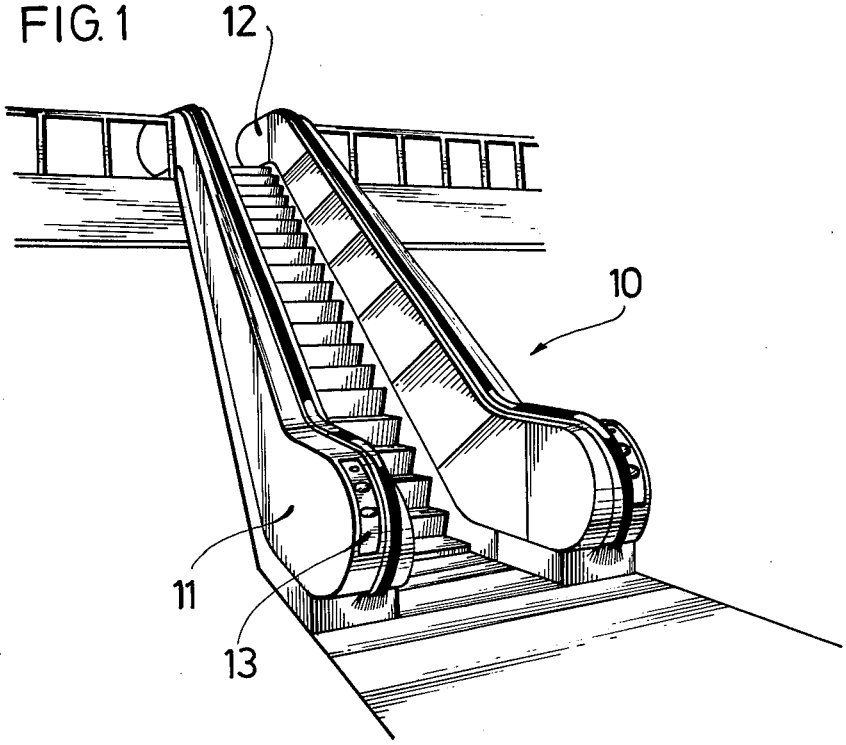
FIG. 1 is a perspective view of an escalator.
Figure 2:
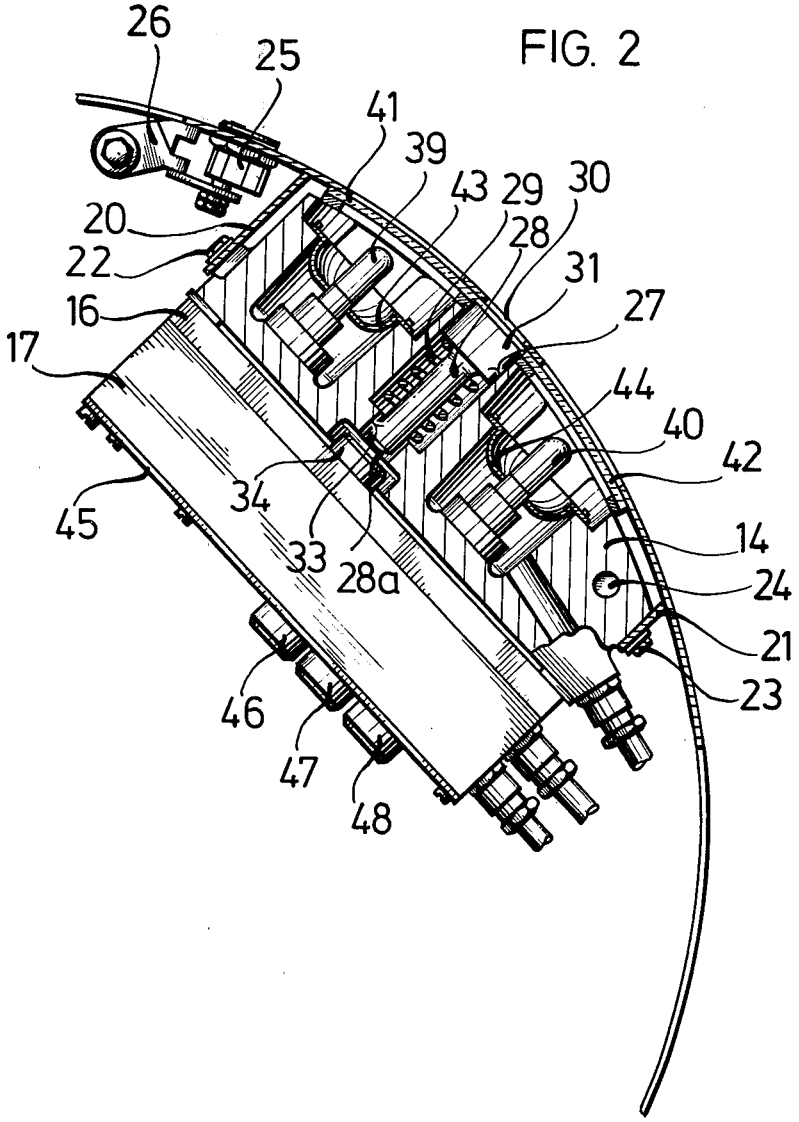
FIG. 2 is a section through the operating flap of the invention, shown in installed condition.
Figure 3:
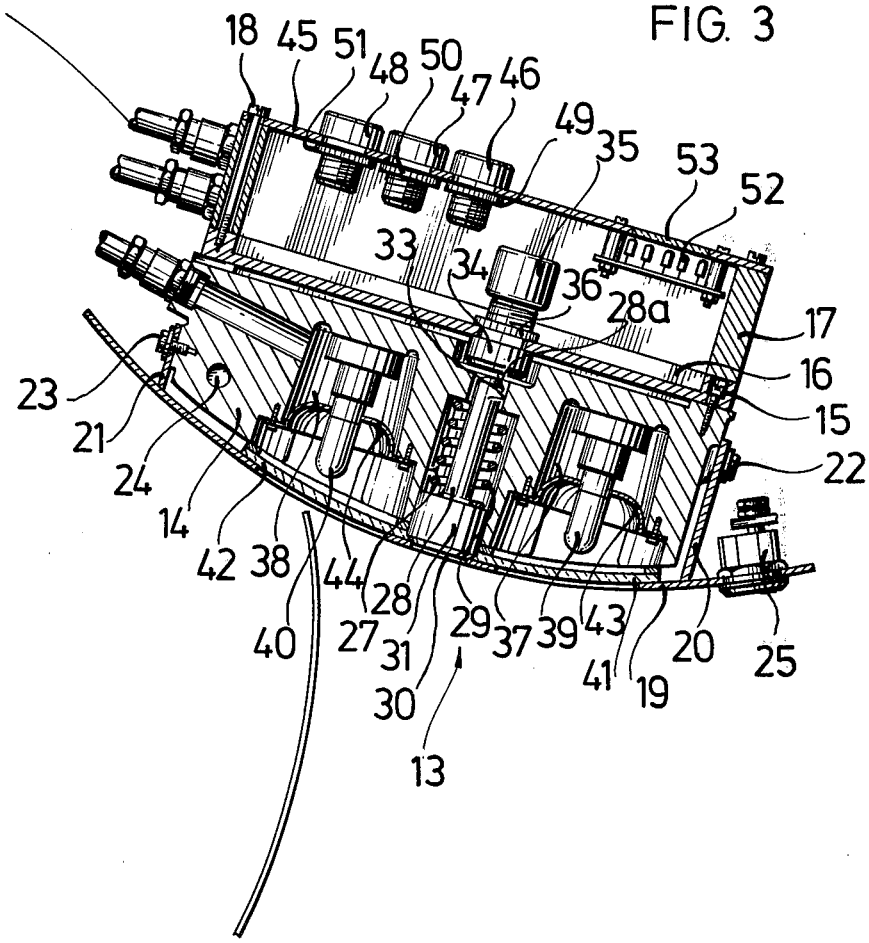
FIG. 3 is a section in accordance with FIG. 2 with the operating flap in the swung-out position for servicing.

An escalator 10 is provided at its lower balustrade head 11 and on its upper balustrade head 12, on both sides, with one flap 13 each, on the inside of which there are arranged the means for the operation and the signal means for warning the passersby. The flap 13 comprises of a housing body 14 and a switch housing 16, 17 which is screwed to the housing body 14 by screws 15, the two parts being fastened together by screws 18. The housing body 14 is covered off from the outside by means of a cover 19 which is screwed by means of brackets 20, 21 and screws 22, 23 to the housing body 14. The flap 13 which comprises essentially the above-described parts 14, 16, 17 and 19 can be swung outwardly by means of a pivot point 24. On the end opposite the pivot point the flap 13 is secured by a lock 25; a stop 26 limits the movement of the flap 13. The housing body 14 is provided with a central borehole 27 in which there is mounted an actuating ram 28 which is held by a spring 29 against the inner edge of a hole 30 provided in the cover 19. The actuation of the ram 28 is effected from the outside by pressing on the knob 31. The free end **28*a* of the actuating ram 28 is guided by the borehole 33 and defines an end surface located opposite to and spaced a safety distance from the knob 34 for actuating the emergency switch 35. The knob or button 34 and the emergency switch 35 are fastened togther by an annular nut 36 in the switch-housing part 16. On both sides of the actuating ram 28, lamps 39 and 40 are arranged in recesses 37 and 38 in the housing body 14, the light of these lamps shining to the outside through colored diffusion glasses 41 and 42 clamped between the housing body 14 and the cover 19; the intensity of the light of the lamps 39 and 40 is increased by reflectors 43 and 44. Push buttons 46, 47 and 48 are fastened by means of ring nuts 49, 50 and 51 to the cover 45 which closes off the switch housing part 16 and 17 from the outside, in such a manner that the push buttons can be actuated from the lower side. The three push buttons 46, 47 and 48 serve for actuating the escalator 10 for intermittent operation, downward movement and upward movement. Furthermore, light-emitting diodes 52 are arranged on the inside of the cover 45, serving for monitoring and for indicating trouble. The operation of the light-emitting diodes 52 can be observed through a glass 53**.

I claim:

1. In a device for placing an escalator in and out of operation and having a system comprising safety switches, actuating elements and signal bodies, the improvement in which the system comprises:

a flap outwardly swingably mounted on the escalator, said flap having a rear side defining one surface facing an interior of the escalator in a normal position of the flap, and a front side defining another surface facing an exterior of the escalator in the normal position of the flap, the actuating elements constitute means for starting and stopping, respectively, the escalator, and include a first actuating means comprising a push-button for placing the escalator out of operation actuatable when said flap is in the normal position and disposed at said another surface non-projectingly relative the latter when said flap is in the normal position and a second actuating means actuatably disposed at said one surface for intermittently moving the escalator during servicing by actuation thereof when said one plane is exposed upon swinging said flap out of the escalator, means for monitoring the escalator, said second actuating means of said actuating elements and said monitoring means are operatively fastened on the rear side of said flap at said one surface, and said push-button at said another surface cooperating with a respective one of said second actuating means of said actuating elements.

2. The device as set forth in claim 1, wherein:

said respective one of said second actuating means comprises, an emergency push button having a knob formed thereon, an actuating ram means having an end surface facing said knob of said emergency push button and spaced from said knob by a safety distance, said actuating ram means constitutes said first-mentioned push-button for actuating said emergency push button.

3. The device as set forth in claim 2, wherein:

said flap includes an outside cover, a housing body and a switch housing formed with communicating coaxial bores, said emergency switch button and said actuating ram means are disposed in said bores of said switch housing and said housing body, respectively, said actuating ram means has a free actuating end disposed against said cover at said bore thereof.

4. The device as set forth in claim 3, further comprising:

spring means disposed in said bore of said housing body for biasing said actuating ram means against said cover in a direction away from said emergency push button, said cover has a contour conforming continuously to the shape of adjacent portions of said escalator on which said flap is mounted in the normal position of the flap.

5. The device as set forth in claim 1, further comprising:

additional monitoring elements and a switch are arranged on said flap.

6. In a device for placing escalators in and out of operation and having a system comprising safety switches, actuating elements and signal bodies, the improvement in which the system comprises:

a flap outwardly swingably mounted on the escalator, said flap having a rear side facing an interior of the escalator in a normal position of the flap, the actuating elements constitute means for starting and stopping, respectively, the escalator, means for monitoring the escalator, said actuating elements and said monitoring means are fastened on the rear side of said flap, said flap includes, a housing body defining a pivot point means for swingably mounting said flap on the escalator, a switch housing, screw means for connecting said housing body and said switch housing, a cover having a contour conforming to a surface of a balustrade of the escalator and formed with an opening, one of said actuating elements having a free end which extends across said opening, bracket means for connecting said housing body to said cover.

7. The device as set forth in claim 6, further comprising:

a lock connected to one end of said cover remote from said pivot point means, the latter being located adjacent another end of said cover, a stop means secured to said balustrade for cooperating with said lock when said cover is in the normal position of said flap for locking said flap in said normal position.

8. The device as set forth in claim 6, further comprising:

an inner cover, screw means for connecting said inner cover to said switch housing, others of said actuating elements are disposed in said switch housing and extend through said inner cover and are adapted for actuation when said inner cover is exposed upon swinging said flap out of the balustrade.

* * * * *

UNITED STATES PATENT AND TRADEMARK OFFICE

CERTIFICATE OF CORRECTION

PATENT NO. : 4,360,078
DATED : November 23, 1982
INVENTOR(S) : Klaus Schöneweiss It is certified that error appears in the above-identified patent and that said Letters Patent are hereby corrected as shown below:

Column 2, Line 47, "plane" should read --surface--

Signed and Sealed this

*Twenty-second* Day of *March 1983*

[SEAL]

*Attest:*

GERALD J. MOSSINGHOFF

*Attesting Officer*

*Commissioner of Patents and Trademarks*